US009879508B2

(12) United States Patent
Mebratu

(10) Patent No.: US 9,879,508 B2
(45) Date of Patent: Jan. 30, 2018

(54) WIRELINE ASSISTED COILED TUBING PORTION AND METHOD FOR OPERATION OF SUCH A COILED TUBING PORTION

(71) Applicant: Mikias Amare Mebratu, Stavanger (NO)

(72) Inventor: Mikias Amare Mebratu, Stavanger (NO)

( * ) Notice: Subject to any disclaimer, the term of this patent is extended or adjusted under 35 U.S.C. 154(b) by 180 days.

(21) Appl. No.: 14/768,401

(22) PCT Filed: Mar. 4, 2014

(86) PCT No.: PCT/NO2014/050027
§ 371 (c)(1),
(2) Date: Aug. 17, 2015

(87) PCT Pub. No.: WO2014/137220
PCT Pub. Date: Sep. 12, 2014

(65) Prior Publication Data
US 2015/0376994 A1 Dec. 31, 2015

(51) Int. Cl.
*E21B 43/12* (2006.01)
*E21B 17/02* (2006.01)
(Continued)

(52) U.S. Cl.
CPC ..... *E21B 43/121* (2013.01); *E21B 17/023* (2013.01); *E21B 17/20* (2013.01);
(Continued)

(58) Field of Classification Search
CPC ..... E21B 17/023; E21B 17/20; E21B 19/22; E21B 33/076; E21B 33/124; E21B 34/06; E21B 43/121; E21B 43/128
See application file for complete search history.

(56) References Cited

U.S. PATENT DOCUMENTS 4,547,774 A * 10/1985 Gould ..... E21B 17/023 250/263
4,759,406 A * 7/1988 Smith ..... E21B 17/023 166/325
(Continued)

FOREIGN PATENT DOCUMENTS

EP 0518371 A2 12/1992
WO 2008077500 7/2008

OTHER PUBLICATIONS

International Preliminary Report on Patentability for PCT/NO2014/050027 dated May 29, 2015.
(Continued)

*Primary Examiner* — James G Sayre
(74) *Attorney, Agent, or Firm* — Andrus Intellectual Property Law LLP

(57) ABSTRACT

A wireline-assisted coiled-tubing portion is arranged to be lowered into a well in a ground. The wireline-assisted coiled-tubing portion comprises a coiled-tubing portion, the coiled-tubing portion in its entirety being arranged to be lowered into the well; and a wire which is attached to an, in the position of application, upper portion of the coiled-tubing portion, the wire extending from the coiled-tubing portion to the opening of the well at a surface, and the wire being arranged to transmit electrical energy and electrical signals. The coiled tubing portion, in its upper portion, is provided with an upper activatable sealing element arranged to seal an annulus between the coiled-tubing portion and the well; in its upper portion, is provided with at least one opening connecting the interior of the coiled-tubing portion to the surroundings of the coiled-tubing portion; in a lower portion, is provided with an activatable sealing element arranged to seal an annulus between the coiled-tubing portion and the well, the sealing element creating a lower zone below the sealing element; and in its lower portion, is
(Continued)

provided with a tool allowing fluid flow-through so that the lower zone may be in fluid communication with the annulus through the tool, the interior of the coiled-tubing portion and the opening. A method for the controlled conveyance of a fluid in a well, and a use of a coiled-tubing portion are described as well.

15 Claims, 2 Drawing Sheets

(51) Int. Cl.

| | |
|---|---|
| ***E21B 17/20*** | (2006.01) |
| ***E21B 33/124*** | (2006.01) |
| ***E21B 34/06*** | (2006.01) |
| ***E21B 33/076*** | (2006.01) |
| ***E21B 19/22*** | (2006.01) |

(52) U.S. Cl.
CPC ..... *E21B 19/22* (2013.01); *E21B 33/076* (2013.01); *E21B 33/124* (2013.01); *E21B 34/06* (2013.01); *E21B 43/128* (2013.01)

(56) References Cited

U.S. PATENT DOCUMENTS

| | | | | |
|---|---|---|---|---|
| 5,337,821 | A | 8/1994 | Peterson | |
| 5,351,533 | A * | 10/1994 | Macadam | E21B 47/06 166/316 |
| 8,307,917 | B2 * | 11/2012 | Kotsonis | E21B 4/18 166/385 |
| 2003/0170077 | A1 | 9/2003 | Herd et al. | |
| 2004/0251022 | A1 | 12/2004 | Smith | |
| 2008/0190605 | A1 * | 8/2008 | Clapp | E21B 33/1246 166/250.17 |
| 2009/0078424 | A1 * | 3/2009 | Carossino | E21B 4/04 166/341 |
| 2012/0222856 | A1 | 9/2012 | Head | |

OTHER PUBLICATIONS

International Search Report and Written Opinion for PCT/NO2014/050027 dated May 22, 2014.
Written Opinion for PCT/NO2014/050027 dated Mar. 26, 2015.
Written Opinion for PCT/NO2014/050027 dated May 12, 2015.
EPO Communication, EP Patent Application No. 14760045.6, dated Sep. 19, 2017.

* cited by examiner

WIRELINE ASSISTED COILED TUBING PORTION AND METHOD FOR OPERATION OF SUCH A COILED TUBING PORTION

CROSS-REFERENCE TO RELATED APPLICATIONS

This application is the U.S. national stage application of International Application PCT/NO2014/050027, filed Mar. 4, 2014, which international application was published on Sep. 12, 2014, as International Publication WO2014/137220 in the English language. The international application is incorporated herein by reference, in entirety. The international application claims priority to Norwegian Patent Application No. 20130324, filed Mar. 5, 2013, which is incorporated herein by reference, in entirety.

FIELD

The invention relates to an apparatus for carrying out work down in a well, particularly a petroleum well. More specifically, the invention relates to an apparatus for so-called light well intervention. The apparatus combines the advantages of a wireline operation and a coiled-tubing operation.

BACKGROUND

By a well is meant a well which has been drilled into the ground, either on land or on a seabed. By a petroleum well is meant a well which has been drilled for the recovery of either gas or oil or both. A petroleum well may produce gas, oil or both, or the well may have the purpose of increasing the recovery of petroleum, for example by giving pressure support to a petroleum reservoir.

A well or petroleum well requires maintenance over the life of the well. Examples of such maintenance work include perforating the production tubing in gas- and oil-producing zones; cementing the annulus; setting plugs and packers; removing sand, sediments and deposits; activating and shutting valves; deploying pumps; and cutting and removing production tubing and casing. Such work may further include logging the well. It is known that such maintenance may be carried out as so-called light well intervention. For each of the different tasks, a suitable tool has been developed, which is lowered into or run into the well.

Light well intervention includes so-called wireline equipment and so-called coiled tubing. A wireline tool is lowered into the well inside a production tubing or its equivalent, hanging on a wire. The wire may be a spun wire or a smooth wire which is termed a slickline in the art. The wire also includes an electrical cable for transmitting electrical energy and cables for transmitting control signals and acquired data. At its end portion, the wire may be provided with a weight. The wire may be used in vertical wells and in wells deviating somewhat from the vertical, as only gravitational forces are acting on the weight and/or the tool. To remedy one of the drawbacks of wire operations, self-propelled tractors have been developed, which are attached to the end portion of a wire.

The electrical conductor supplies the tractor with energy so that it may move, by wheel drive or crawler drive, in wells that have been drilled with deviation, like horizontal wells. The tractor pushes the tool in front of itself down or into the well. Wireline equipment has the advantage of being relatively light-weight, taking up little space and being quick to mobilize and demobilize. One drawback to known wireline equipment is that it cannot convey or carry gas or liquid.

Coiled tubing is fed down the well inside the production tubing or its equivalent. The coiled tubing will extend from the desired location in the well, where the lower portion of the coiled tubing is positioned, up to the surface. The coiled tubing may thus be several thousand meters long. At its lower end portion, the coiled tubing is provided with a tool which has been selected on the basis of the purpose of the task. The coiled tubing has the advantage, among others, that it can be fed into high-pressure wells, that it can be run into wells with deviations and into wells with horizontal portions. The coiled tubing is hollow and therefore forms a continuous channel from the free end portion of the coiled tubing downhole up to the surface. This enables fluid conveyance through the coiled tubing. The fluid may comprise cement, gas and chemical solutions. Such conveyance of fluids down into the well or up from the well is not possible with wire operations or with a wire and tractor. A drawback to coiled tubing is that the equipment is relatively heavy, the equipment requires a derrick over the well head, and it takes time to mobilize and demobilize the equipment. Another drawback is that a fluid flowing through a coiled tubing is exposed to greater friction because of the smaller inner diameter of the coiled tubing compared with the inner diameter of the surrounding production tubing.

The patent document U.S. Pat. No. 5,337,821 discloses an apparatus for measuring flow rates in a reservoir in the ground and the production capacity of the reservoir, among other things. The apparatus is lowered into a well in the ground by means of a logging cable. The apparatus includes lower and upper inflatable packers which, between them, isolate a zone which is to be tested. The apparatus is provided with openings in the isolated zone, openings above the upper packer and an internal channel between the openings in the isolated zone and the openings above the upper packer. A pump may displace a fluid from the zone between the packers to an area above the upper packer through the internal channel. A chamber for sampling a fluid sample is shown as being positioned below the lower packer. The chamber is in fluid communication with the isolated zone. The chamber is not in fluid communication with the well below the lower packer. When the packers of the apparatus have been sealingly activated, there is no fluid communication between the well below the lower packer and the well above the upper packer, nor any fluid communication between the well below the lower packer and the isolated zone.

SUMMARY

The invention has for its object to remedy or reduce at least one of the drawbacks of the prior art or at least provide a useful alternative to the prior art.

The object is achieved through features which are specified in the description below and in the claims that follow.

In a first aspect, the invention relates to a wireline-assisted coiled-tubing portion arranged to be lowered into a well in the ground, the wireline-assisted coiled-tubing portion including:

- a coiled-tubing portion, the coiled-tubing portion in its entirety being arranged to be lowered into the well; and
- a wire which is attached to an, in the position of application, upper portion of the coiled-tubing portion, the wire extending from the coiled-tubing portion to the opening of the well at a surface, and the wire being arranged to transmit electrical energy and electrical signals;

wherein the coiled-tubing portion:

in its upper portion, is provided with an upper activatable sealing element arranged to seal an annulus between the coiled-tubing portion and the well;

in its upper portion, is provided with at least one opening connecting the interior of the coiled-tubing portion to the surroundings of the coiled-tubing portion;

in a lower portion, is provided with an activatable sealing element arranged to seal an annulus between the coiled-tubing portion and the well, the sealing element creating a lower zone below the sealing element; and in its lower portion, is provided with a tool allowing fluid flow-through; so that the lower zone may be in fluid communication with the annulus through the tool, the interior of the coiled-tubing portion and the opening.

The tool may include a valve, a pump for fluid communication between the lower zone and the interior of the coiled-tubing portion. The tool may include a high-pressure flushing system for fluid communication between the interior of the coiled-tubing portion and the lower zone.

The coiled-tubing portion may further include at least one activatable zone-sealing element positioned between the upper sealing element and the sealing element and at least one opening positioned in the coiled-tubing portion between two sealing elements. The opening is openable and closable.

The activatable sealing element may be arranged to take a first active position, the sealing element in its first active position being arranged to slide along the inside of a fixed pipe.

In a second aspect, the invention relates to a method for the controlled conveyance of fluid in a well, the method including fluid flowing through a fixed pipe in the well between the opening of the well at a surface and an, in the position of application, upper portion of a coiled-tubing portion as described in the foregoing, the coiled-tubing portion having been lowered in its entirety into the well through the fixed pipe, and through a portion of the coiled-tubing portion.

The fluid may consist of a liquid.

The fluid may flow through a valve in the lower portion of the coiled-tubing portion.

The fluid may flow through a pump in the lower portion of the coiled-tubing portion.

The fluid may flow through a high-pressure flushing system in the lower portion of the coiled-tubing portion into a lower zone.

The fluid may flow through an opening in the coiled-tubing portion, the opening being positioned between activatable sealing elements creating a zone between the surface of the coiled-tubing, the well and the sealing elements.

The method may further include moving the coiled-tubing portion in a controlled manner within a fixed pipe or a liner, by:

a sealing element being activated to a first active position arranged to slide along the inside of the fixed pipe or the inside of the liner;

a pump at the lower end portion of the coiled-tubing portion being activated so that fluid is pumped through the pump, through the coiled-tubing portion and out of an opening at the upper end portion of the coiled-tubing portion, so that the pressure on the bottom side of the sealing element will be lower than the pressure on the top side of the sealing element, and so that the pressure difference displaces the coiled-tubing portion down the fixed pipe or the liner.

In a third aspect, the invention relates to the use of a coiled-tubing portion as described in the foregoing for the controlled conveyance of a fluid in a well.

BRIEF DESCRIPTION OF THE DRAWINGS

In what follows, examples of preferred embodiments are described, which are visualized in the accompanying drawings, in which.

DETAILED DESCRIPTION OF THE DRAWINGS

Figure 1:
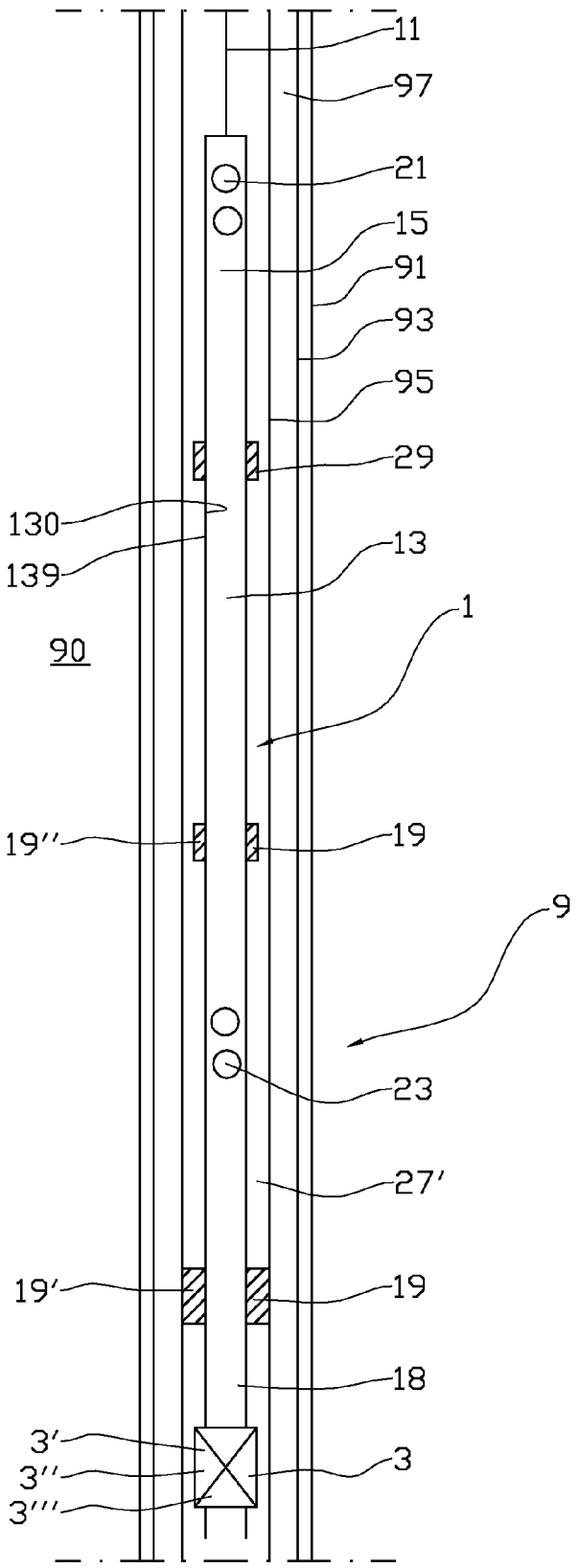
FIG. 1 shows a coiled-tubing portion positioned in a portion of a petroleum well, the coiled-tubing portion being connected to the surface by a wire.

In the figures, the reference numeral 1 indicates a wireline-assisted coiled-tubing portion according to the invention. The wireline-assisted coiled-tubing portion 1 includes a wire 11 of a type known per se and a section of a coiled tubing 13 of a type known per se, termed coiled-tubing portion 13 hereinafter. The wire 11 is attached to the coiled-tubing portion 13 at the upper end portion 15 of the coiled-tubing portion 13.

In FIG. 1, the wireline-assisted coiled-tubing portion 1 is positioned in a petroleum well 9 in a formation 90. In a known manner, the petroleum well 9 includes well linings 91, 93 and a production tubing 95.

Figure 2:
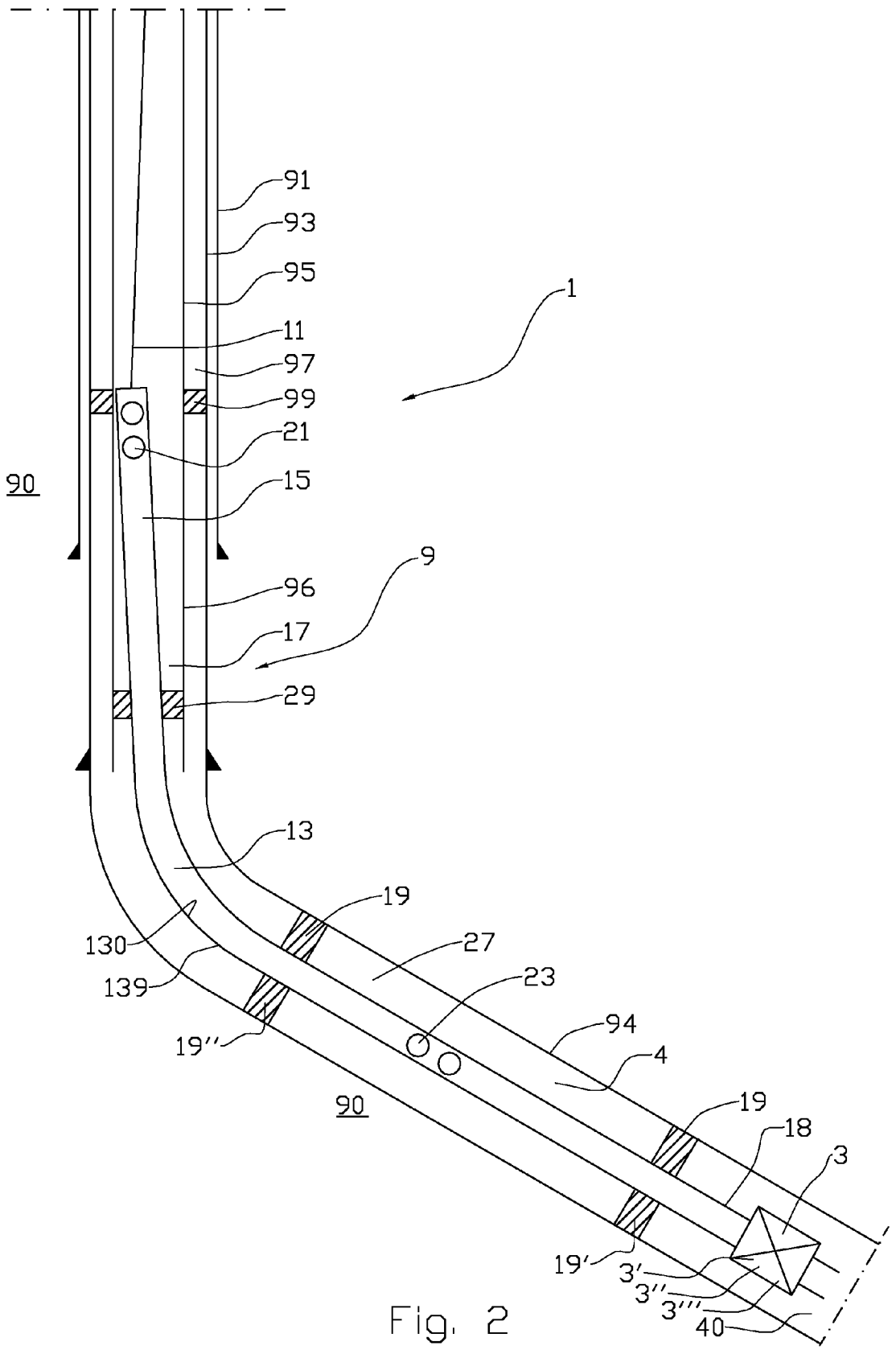
FIG. 2 shows the coiled-tubing portion positioned in a lower portion of the petroleum well.

FIG. 2 shows the wireline-assisted coiled-tubing portion 1 positioned in a lower portion of the petroleum well 9. FIG. 2 shows that the petroleum well 9 further includes an optional extension pipe, a so-called liner 94. The annulus 97 is sealed in a known manner with a sealing element 99 of a type known per se.

The coiled-tubing portion 13 is provided with a plurality of activatable sealing elements 19, 29 of a type known per se. The sealing elements 19, 29 are attached to the outside 139 of the coiled-tubing portion 13. The upper end portion 15 of the coiled-tubing portion 13 is provided with an upper, activatable sealing element 29. By an activatable sealing element 29 is meant, here and in what follows, that the sealing element 29 may optionally take a passive, non-sealing position as shown in FIG. 1, and an active, sealing position as shown in FIG. 2. The sealing element 29 may be provided with wedges or slips (not shown) to grip against the production tubing 95, the liner 94 or the formation 90 to hold the coiled-tubing portion 13 in position, as shown in FIG. 2. This makes it possible to position the wireline-assisted coiled-tubing portion 1 in the desired place, carry out the operation and remove the wireline-assisted coiled-tubing portion 1 after the operation has been performed. An annulus 17 which has been formed between the upper portion 15 of the wireline-assisted coiled-tubing portion 1 and a portion 96 of the production tubing 95 has been sealed with the activatable sealing element 29 as shown in FIG. 2.

The coiled-tubing portion 13 is shown as being provided with a plurality of activatable sealing elements 19 on its outer side. In FIG. 1, a lower sealing element 19' on the lower portion 18 of the coiled-tubing portion 13 is shown in a first active position such that the sealing element 19' is slidingly abutting against the inside of the production tubing 95, thereby forming an annular piston in an annulus 27' between the coiled-tubing portion 13 and the production tubing 95. The coiled-tubing portion 13 is further provided with a zone-sealing element 19". In FIG. 1, the zone-sealing element 19" is shown in a passive position and, in FIG. 2, it is shown in an active position.

In FIG. 2, the lower sealing element 19' is shown in a second active position in which it seals an annulus 27 between the coiled-tubing portion 13 and the liner 94. In its second active position too, the sealing element 19' can seal between the outer side of the coiled-tubing portion 13 and the formation 90 where a liner 94 has not been used. The sealing elements 19 form a zone 4 between themselves. In the figure, two sealing elements 19 and one zone 4 between the lower sealing element 19' and the zone-sealing element 19" are shown. Between themselves, three sealing elements 19 will form two zones 4. Four sealing elements 19 will form three zones 4 between themselves. The invention is not limited to a specific number of sealing elements 19 and zones 4. The lowermost sealing element 19' creates a lower zone 40 at the lower end portion 18 of the coiled-tubing portion 13.

At its lower end portion 18, the coiled-tubing portion 13 is provided with a tool 3. The tool 3 may comprise a pump 3' and a valve 3". In an alternative exemplary embodiment, the tool 3 may comprise a high-pressure flushing system 3'", termed a jetting tool in the art.

The tool 3, 3', 3", 3'" is adapted for fluid communication to exist between the lower zone 40 and the inside 130 of the coiled-tubing portion 13. Fluid may optionally flow from the lower zone 40 into the coiled-tubing portion 13 or from the coiled-tubing portion 13 into the lower zone 40.

At its upper end portion 15, the coiled-tubing portion 13 is provided with at least one opening 21 between the inside 130 and the outside 139 of the coiled-tubing portion 13. The opening 21 may be closed and opened on signals transmitted through the wire 11. The coiled-tubing portion 13 is shown with a further opening 23 between the inside 130 and the outside 139 of the coiled-tubing portion 13. The opening 23 is positioned in a portion between two sealing elements 19. The opening 23 may be closed and opened on signals transmitted through the wire 11. The valve 3" may be opened and closed on signals transmitted through the wire 11.

The coiled-tubing portion 13 which, in one exemplary embodiment, is provided with at least one lower sealing element 19' and one sealing element 29, at least one opening 21 and a tool 3 including one valve 3", is positioned in a desired place in a well 9. To facilitate positioning, the lower coiled-tubing portion 13 may be lowered down the production tubing 95 by activating the lower sealing element 19' to its first active position. The tool 3 further includes a pump 3'. By activation of the pump 3', fluid will flow from below the tool 3 through the pump 3', into the coiled-tubing portion 13 and out through the opening 21. The pressure on the bottom side of the sealing element 19' becomes lower than the pressure on the top side of the sealing element 19', and the pressure difference will move the coiled-tubing portion 13 downwards in the production tubing 95. A corresponding method may be used in the liner 94. In its first active position, the sealing element 19' is not fluid-tight against the inner wall of the production tubing 95 or the liner 94, so that some fluid will flow from the top side of the sealing element 19' to the bottom side of the sealing element 19'. This has the advantage, among others, that the pressure above the sealing element 19' cannot exceed a critical value, and that the pressures above and below the sealing element 19' will be equalized when the pump 3' stops.

When the coiled-tubing portion 13 is in the desired position, the sealing element 29 is activated by means of a control signal through the wire 11. Electrical energy for activating the sealing element 29 is supplied through the wire 11. The sealing element 29 plugs the annulus 17. The sealing element 19' is activated to its second active position in the same way and plugs the annulus 27. The opening 21 is opened and the valve 3" is opened. Thereby the production tubing 95 is in controlled fluid communication with the lower zone 40 through the coiled-tubing portion 13.

A chemical which is desired to be carried in a controlled manner to the zone 40 in the well 9 is carried down the well 9 through the production tubing 95, through the opening 21 and the coiled-tubing portion 13, through the valve 3" and into the zone 40. The chemical may include water for maintaining the pressure in a petroliferous reservoir as it is known in the art.

The coiled-tubing portion 13, which, in an alternative exemplary embodiment, is provided with at least one lower sealing element 19' and one sealing element 29, at least one opening 21 and one valve 3", is further provided with one zone-sealing element 19" and at least one opening 23 positioned between the lower sealing element 19' and the zone-sealing element 19", is positioned in the desired place in a well 9. The sealing element 29 is activated by means of a control signal through the wire 11. Electrical energy for activating the sealing element 29 is supplied through the wire 11. The sealing element 29 plugs the annulus 17. The sealing elements 19', 19" are activated in the same way and plug the annulus 27. The opening 21 is opened and the valve 3" is opened whereas the opening 23 is kept closed. Thereby the production tubing 95 is in controlled fluid communication with the zone 40 through the coiled-tubing portion 13. The valve 3" is closed and the opening 23 is opened. Thereby the production tubing 95 is in controlled fluid communication with the zone 4 through the coiled-tubing portion 13.

A chemical which is desired to be carried in a controlled manner to the zone 40 in the well 9 is carried down the well 9 through the production tubing 95, through the opening 21 and the coiled-tubing portion 13, through the valve 3" into the zone 40. A chemical which is desired to be carried in a controlled manner to the zone 4 in the well 9 is carried into the well 9 through the production tubing 95, through the opening 21 and the coiled-tubing portion 13, through the opening 23 into the zone 4. The chemical may include water for maintaining the pressure in a petroliferous reservoir.

In one embodiment, the invention may be used to carry cement to a desired location in a well with the aim of plugging the well so that it may be abandoned. In old wells where the formation pressure is low, the cement solution that is supplied from above may have a hydrostatic pressure higher than the formation pressure, and the cement solution may flow in an uncontrolled manner into the formation. By the use of the invention, the coiled-tubing portion 13 is brought to a desired zone as described in the foregoing. The upper sealing element 29 is activated and the cement solution or other plugging material is pumped down to the lower zone 40 through the coiled-tubing portion 13. Then the opening 21 is closed so that the lower zone 40 is isolated from the zone above the coiled-tubing portion 13, such as the annulus 17 or an annulus between the coiled-tubing portion 13 and the liner 94. The lower zone is then also isolated from the hydrostatic pressure in the fluid column above the opening 21. The cement or the other plugging material is then allowed to set.

The person skilled in the art will understand that the use of the coiled-tubing portion 13 is not limited to just carrying a fluid downwards and into the well 9, but can also be used to carry a fluid, either gas or oil, from a selected zone 4 upwards in the well 9 and to the production tubing 95.

The invention claimed is:

1. A wireline-assisted coiled-tubing portion arranged to be lowered into a well in a ground, wherein the wireline-assisted coiled-tubing portion comprises:

a coiled-tubing portion, the coiled-tubing portion in its entirety being arranged to be lowered into the well; and a wire which is attached to an, in the position of application, upper end portion of the coiled-tubing portion, the wire extending from the coiled-tubing portion to the opening of the well at a surface, and the wire being arranged to transmit electrical energy and electrical signals, wherein the coiled tubing portion:

in its upper end portion, is provided with an upper activatable sealing element arranged to seal between the coiled-tubing portion and the well forming an annulus above the sealing element;

in its upper end portion, is provided with at least one opening between an interior and an outside connecting the interior of the coiled-tubing portion to a surroundings of the coiled-tubing portion;

in a lower end portion, is provided with an activatable lower sealing element arranged to seal between the coiled-tubing portion and the well, the lower sealing element creating a lower zone below the lower sealing element; and in its lower end portion, is provided with a tool allowing fluid flow-through so that the lower zone may be in fluid communication with the annulus through the tool, the interior of the coiled-tubing portion and the opening;

wherein the coiled-tubing portion further includes at least one activatable zone-sealing element positioned between the upper sealing element and the lower sealing element and at least one opening positioned in the coiled-tubing portion between two sealing elements.

2. The wireline-assisted coiled-tubing portion in accordance with claim 1, wherein the upper activatable sealing element is attached to the outside of the coiled-tubing portion.

3. The wireline-assisted coiled-tubing portion in accordance with claim 1, wherein the tool includes a valve for fluid communication between the lower zone and the interior of the coiled-tubing portion.

4. The wireline-assisted coiled-tubing portion in accordance with claim 1, wherein the tool includes a pump for fluid communication between the lower zone and the interior of the coiled-tubing portion.

5. The wireline-assisted coiled-tubing portion in accordance with claim 1, wherein the tool includes a high-pressure flushing system for fluid communication between the interior of the coiled-tubing portion and the lower zone.

6. The wireline-assisted coiled-tubing portion in accordance with claim 1, wherein the at least one opening is openable and closable.

7. The wireline-assisted coiled-tubing portion in accordance with claim 1, wherein the coiled-tubing portion further includes at least two activatable zone-sealing elements positioned between the upper sealing element and the lower sealing element and at least one opening positioned in the coiled-tubing portion between two sealing elements.

8. The wireline-assisted coiled-tubing portion in accordance with claim 1, wherein the activatable sealing element is attached to the outside of the coiled-tubing portion.

9. A wireline-assisted coiled-tubing portion arranged to be lowered into a well in a ground, wherein the wireline-assisted coiled-tubing portion comprises:

a coiled-tubing portion, the coiled-tubing portion in its entirety being arranged to be lowered into the well; and a wire which is attached to an, in the position of application, upper end portion of the coiled-tubing portion, the wire extending from the coiled-tubing portion to the opening of the well at a surface, and the wire being arranged to transmit electrical energy and electrical signals, wherein the coiled tubing portion:

in its upper end portion, is provided with an upper activatable sealing element arranged to seal between the coiled-tubing portion and the well forming an annulus above the sealing element;

in its upper end portion, is provided with at least one opening between an interior and an outside connecting the interior of the coiled-tubing portion to a surroundings of the coiled-tubing portion;

in a lower end portion, is provided with an activatable lower sealing element arranged to seal between the coiled-tubing portion and the well, the lower sealing element creating a lower zone below the lower sealing element; and in its lower end portion, is provided with a tool allowing fluid flow-through so that the lower zone may be in fluid communication with the annulus through the tool, the interior of the coiled-tubing portion and the opening;

wherein the lower activatable sealing element is arranged to take a first active position, the lower sealing element, in its first active position, being arranged to slide along the inside of a fixed pipe.

10. A method for the controlled conveyance of a fluid in a well, wherein the method comprises:

i) lowering a coiled-tubing portion in its entirety into the well through a fixed pipe;

wherein the wireline-assisted coiled-tubing portion comprises:

a coiled-tubing portion, the coiled-tubing portion in its entirety being arranged to be lowered into the well; and a wire which is attached to an, in the position of application, upper end portion of the coiled-tubing portion, the wire extending from the coiled-tubing portion to the opening of the well at a surface, and the wire being arranged to transmit electrical energy and electrical signals, wherein the coiled tubing portion:

in its upper end portion, is provided with an upper activatable sealing element arranged to seal between the coiled-tubing portion and the well forming an annulus above the sealing element;

in its upper end portion, is provided with at least one opening between an interior and an outside connecting the interior of the coiled-tubing portion to a surroundings of the coiled-tubing portion;

in a lower end portion, is provided with an activatable lower sealing element arranged to seal between the coiled-tubing portion and the well, the lower sealing element creating a lower zone below the lower sealing element; and in its lower end portion, is provided with a tool allowing fluid flow-through so that the lower zone may be in fluid communication with the annulus through the tool, the interior of the coiled-tubing portion and the opening;

ii) positioning the coiled-tubing portion at a desired place; and iii) carrying fluid through the fixed pipe between the opening of the well at a surface, through the at least one opening at the upper end portion of the coiled-tubing portion, through a portion of the coiled-tubing portion, and through either at least one opening positioned in the coiled-tubing portion between the lower sealing element and a zone-sealing element positioned between the upper sealing element and the lower sealing element, or through the tool at the lower end portion of the coiled-tubing portion in either a downward or upward direction.

11. The method in accordance with claim 10, wherein the fluid consists of a liquid.

12. The method in accordance with claim 10, wherein the fluid flows through a valve in the lower end portion of the coiled-tubing portion.

13. The method in accordance with claim 10, wherein the fluid flows through a pump in the lower end portion of the coiled-tubing portion.

14. The method in accordance with claim 10, wherein the fluid flows through a high-pressure flushing system in the lower end portion of the coiled-tubing portion into a lower zone.

15. The method in accordance with claim 10, wherein the method in step i) and ii) further includes moving the coiled-tubing portion in a controlled manner within the fixed pipe or a liner, by:

the lower sealing element being activated to a first active position arranged to slide along the inside of the fixed pipe or the inside of the liner;

a pump at the lower end portion of the coiled-tubing portion being activated so that fluid is pumped through the pump, through the coiled-tubing portion and out of an opening at the upper end portion of the coiled-tubing portion, so that the pressure on the bottom side of the lower sealing element will be lower than the pressure on the top side of the lower sealing element, and so that the pressure difference displaces the coiled-tubing portion down the fixed pipe or the liner.

* * * * *